US006752518B2

(12) United States Patent
Katsuma

(10) Patent No.: US 6,752,518 B2
(45) Date of Patent: Jun. 22, 2004

(54) BULB SOCKET AND A METHOD FOR MOUNTING IT

(75) Inventor: Takatoshi Katsuma, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 8 days.

(21) Appl. No.: 10/281,449

(22) Filed: Oct. 25, 2002

(65) Prior Publication Data

US 2003/0081417 A1 May 1, 2003

(30) Foreign Application Priority Data

Oct. 30, 2001 (JP) ..... 2001-332318

(51) Int. Cl.[7] ..... F21V 31/00
(52) U.S. Cl. ..... 362/267; 362/457
(58) Field of Search ..... 362/101, 267, 362/457, 548, 549; 439/271, 559, 277, 280, 556

(56) References Cited

U.S. PATENT DOCUMENTS 4,569,006 A * 2/1986 Bergin et al. ..... 362/549
4,642,739 A * 2/1987 Daumuller et al. ..... 362/548
5,842,771 A * 12/1998 Thrasher et al. ..... 362/101
6,039,579 A 3/2000 Paul et al.
6,129,443 A 10/2000 Murata et al.

FOREIGN PATENT DOCUMENTS

DE 16 10 933 7/1950
JP 4-51784 4/1992

* cited by examiner

*Primary Examiner*—Y My Quach Lee
(74) *Attorney, Agent, or Firm*—Anthony J. Casella; Gerald E. Hespos

(57) ABSTRACT

A bulb socket (S) has a main body (D) and a restricting projection (15) is formed continuously on an outer circumferential surface (18) of the main body (D) over the entire circumference. An O-ring (14) is fitted on the main body (D) behind the restricting projection (15). Thus, the restricting projection (15) contacts the O-ring (14) during detachment of a bulb socket (S), thereby separating the O-ring (14) from a sealing surface (16*a*) of an edge (16) of a mount hole (11). Further, the restricting projection (15) contacts a contact surface (16*b*) of the edge (16) during the mounting of the bulb socket (S), thereby preventing the bulb socket (S) from being pushed any further. This prevents the excessive squeezing of the O-ring (14) and prevents a reduction in its sealing function.

19 Claims, 5 Drawing Sheets

BULB SOCKET AND A METHOD FOR MOUNTING IT

BACKGROUND OF THE INVENTION

1. Field of the Invention

The present invention relates to a bulb socket having a watertight structure and to a method for mounting or assembling it.

2. Description of the Related Art

Japanese Unexamined Utility Model Publication No. 4-51784 and FIG. 5 herein disclose a known bulb socket. The letter B in FIG. 5 identifies the known bulb socket that has a bulb i mounted in a socket main body 2. A ring-shaped seal 3 is fitted on the outer side surface of the main body 2. The bulb socket B is mounted on a panel 4 so that the seal 3 is squeezed between a flange 2*a* of the main body 2 and an edge of a mount hole 5 in the panel 4. Thus, the seal 3 is pressed in sealing contact with the flange 2*a* and the edge of the mount hole 5. Locking pieces 2*b* are provided on the outer surface of the socket main body 2 and are introduced through escaping portions 5*a* formed at the edge of the mount hole 5. Thus, the entire bulb socket B is turned circumferentially while the seal 3 is pressed against the panel 4 by the flange 2*a*. As a result, the engagement of the locking pieces 2*b* with the edge of the mount hole 5 prevents the bulb socket B from coming out.

The bulb socket B may have to be detached from the panel 4, for example, to exchange the bulb 1. However, the seal 3 is held strongly in pressing contact with the edge of the mount hole 5 when the bulb socket B is mounted, and the seal 3 may remain held in pressing contact with the edge of the mount hole 5. Consequently, the seal 3 may come off the main body 2 as the bulb socket B is detached.

The seal 3 may be squeezed excessively between the flange 2*a* of the main body 2 and the edge of the mount hole 5, if the flange 2*a* of the main body 2 is pressed too hard against the edge of the mount hole 5 during the mounting of the bulb socket B. If the bulb socket B is turned circumferentially in this state, a sliding resistance between the seal 3 and the flange 2*a* and the resistance between the seal 3 and the mount hole 5 increases, and a shear force acts on the seal 3 in the circumferential direction. As a result, the seal 3 is deformed improperly and cannot provide a secure sealing.

The invention was developed in view of the above problem and an object thereof is to prevent a reduction in sealing function of a sealing member.

SUMMARY OF THE INVENTION

The invention relates to a bulb socket with a main body for receiving a bulb. The main body has an outer surface with at least one lock for locking the main body in a mount hole of a bulb casing. A seal is mounted on the outer surface of the main body to provide sealing between the mount hole and the main body. The outer surface of the main body includes a restricting projection between the seal and the mount hole for contacting the edge of the mount hole from the outside. The restricting projection limits the depth of insertion of the bulb socket in the mount hole and hence prevents excessive resilient deformation of the seal in response to forces generated as the bulb socket is being mounted. Thus, the seal is not deformed improperly even if the bulb socket is turned in this state, and the seal is assured of displaying its sealing function.

The main body preferably can be turned circumferentially to engage the lock with an edge of the mount hole from inside. Thus, the main body will not come out during mounting into the bulb casing.

The bulb socket preferably comprises a flange on the outer circumferential surface of the main body for contacting the seal and restricting a backward loose movement of the seal. Thus, sealing is provided between the mount hole and the main body by squeezing the seal between the flange and a sealing surface of the edge of the mount hole to resiliently deform the seal in a mounted state of the bulb socket.

The seal is held in pressing contact with the outer side of the edge of the mount hole. However, the restricting projection on the outer surface of the main body contacts the seal and separates the seal from the edge of the mount hole as the bulb socket is detached. Thus, the seal will not come off the main body as the bulb socket is detached.

The seal could be pushed strongly against the edge of the mount hole by the flange during the mounting of the bulb socket. However, the restricting projection contacts the outer side of the edge of the mount hole before the seal undergoes an excessive resilient deformation. Thus, the bulb socket cannot be pushed any deeper. The seal is not deformed improperly even if the bulb socket is turned in this state and, therefore, can display its sealing function.

The restricting projection preferably is formed substantially continuously over the entire circumferential surface of the main body. Accordingly, the strength against a pushing force from the edge of the mount hole when the bulb socket is pushed is higher than on a bulb socket with a plurality of circumferentially spaced restricting projections. Thus, breakage and bending of the restricting projection can be avoided. Further, oblique mounting of the socket main body into the mount hole can be avoided because the restricting projection uniformly contacts the edge of the mount hole over the entire circumference.

The restricting projection preferably is formed with a contact surface to be held in pressing contact with the seal when the seal is squeezed resiliently between the flange and the sealing surface. Accordingly, the seal is held in pressing contact with the edge of the mount hole, the flange of the socket main body, and the contact surface of the restricting projection. Thus, more secure sealing is provided between the mount hole and the socket main body.

The restricting projection preferably is formed with a slanted surface that extends substantially along the outer circumferential surface of the seal. Accordingly, the seal contacts a wide area, i.e. substantially the entire slanted surface, when pressed against the restricting projection. Thus, the seal will not be recessed locally.

A groove may be formed in the outer circumferential surface of the main body for at least partly accommodating the seal.

The invention also is directed to a method for mounting a bulb socket. The method comprises providing a main body with a restricting projection and a lock on an outer circumferential surface of the main body. The method then comprises fitting a seal on the outer circumferential surface of the main body and inserting the main body into a mount hole of a bulb casing so that the restricting projection contacts and edge of the mount hole from the outside. The contact between the restricting projection and the outer side of the edge of the mount hole prevents the seal from undergoing an excessive resilient deformation even if strong pushing forces are used during the mounting of the bulb socket. Thus, the seal provides reliable sealing between the mount hole and the main body.

The method may further comprise locking the main body to the bulb casing preferably by circumferentially turning the main body to engage a lock with an edge of the mount hole from inside. Thus, the main body will not come out during the mounting into the bulb casing.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
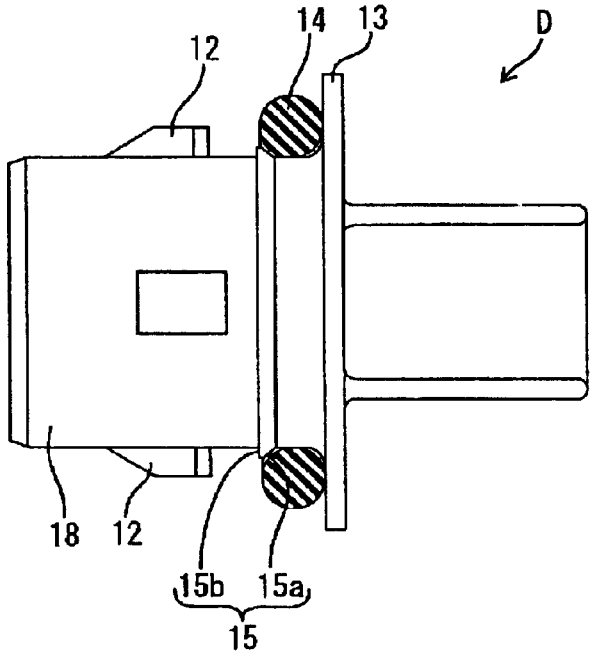
FIG. 1 is a side view of a socket main body.
Figure 2:
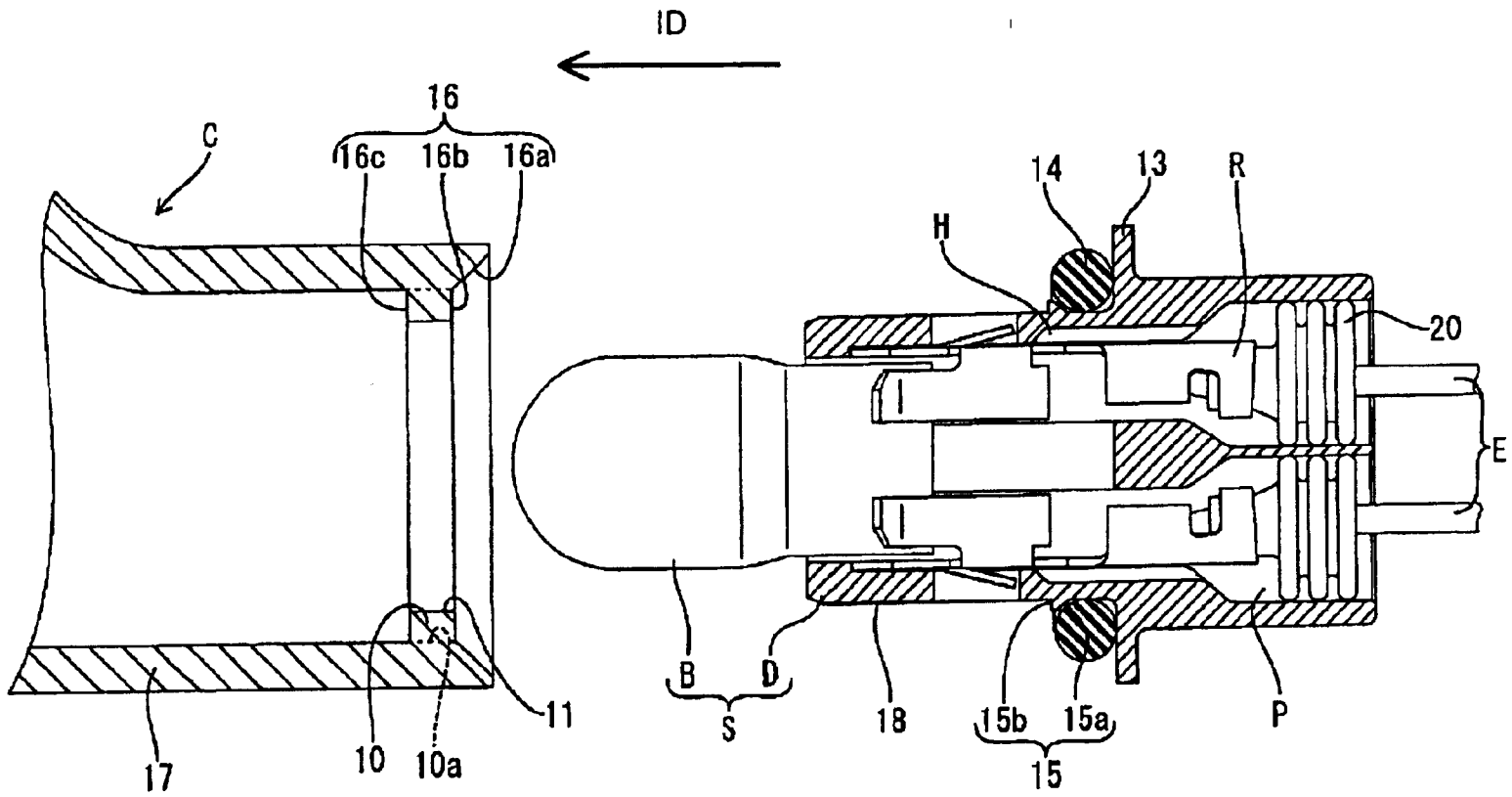
FIG. 2 is a section of a bulb casing and a bulb socket.
Figure 3:
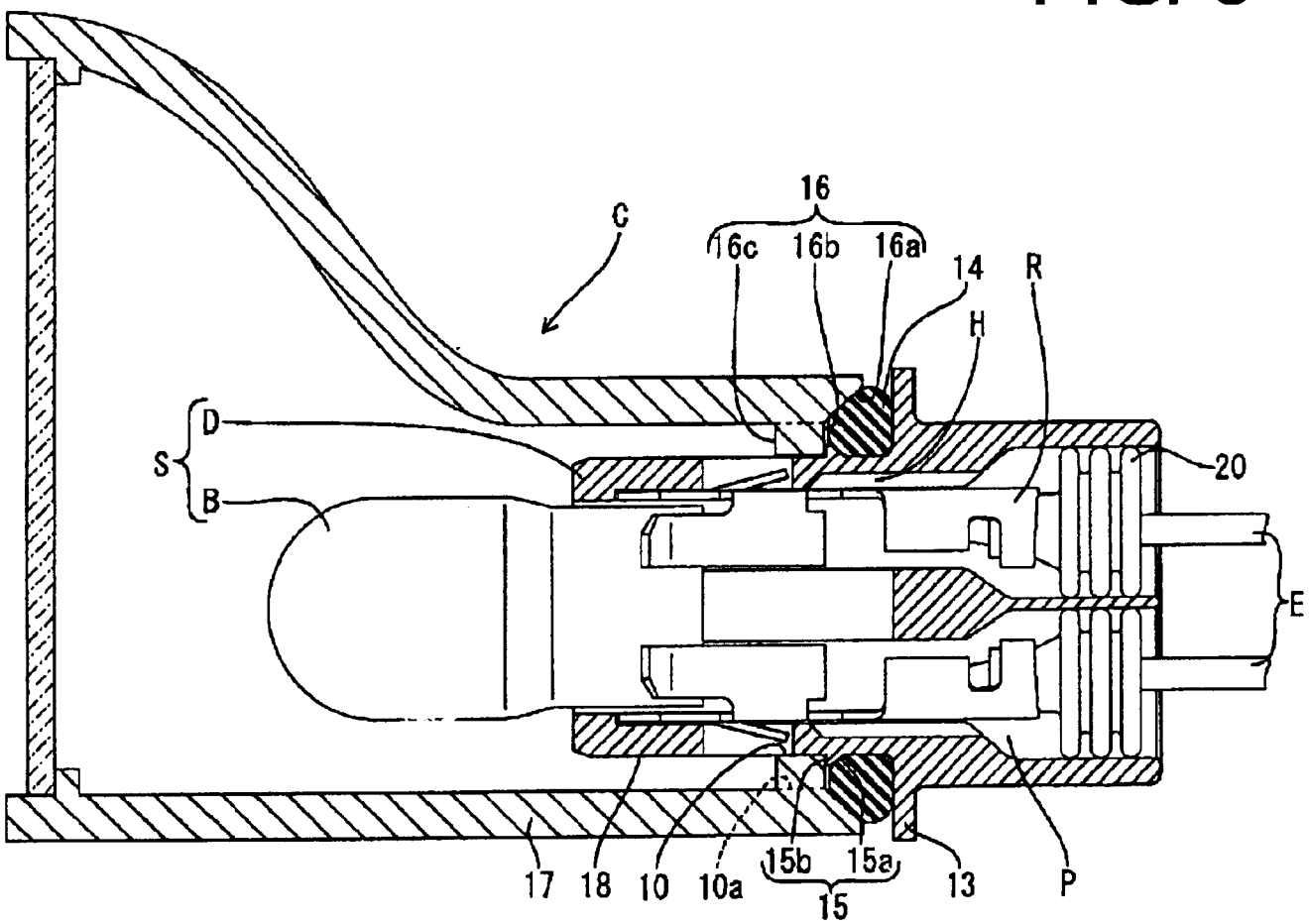
FIG. 3 is a section of the bulb casing and socket in a mounted state.

A bulb socket according to the invention is identified by the letter S in FIGS. 1 to 4, and preferably is used with a bulb casing C for a vehicle light. An annular projection 10 is formed slightly forward of the rear end of the bulb casing C and defines a mount hole 11 with an inside diameter slightly larger than the outside diameter of the bulb socket S. Thus, the bulb socket S can be mounted in an inserting direction ID in the mount hole 11. The annular projection 10 is formed with one or more escaping portions 10*a*. A sealing surface 16*a* extends from the annular projection 10 to the rear end of the bulb casing C and is slanted to widen toward the back. The annular projection 10 has a rearwardly facing contact surface 16*b* and a forwardly facing locking surface 16*c*. Collectively the sealing surface 16*a*, the contact surface 16*b* and the locking surface 16*c* define an edge 16 for the mount hole 11. Portions of the bulb casing forward of the annular projection 10 define a hollow cylinder 17.

The bulb socket S has a synthetic resin main body D in the form of a hollow tube with opposite front and rear ends. The open front end of the main body D defines and accommodating portion H that accommodates two terminal fittings R. A bulb B can be inserted into the open front of the accommodating portion H for connection with the terminal fittings R. The rear end of the main body D defines a sealing portion P for individually accommodating portions of the terminal fittings R crimped, bent or folded into connection with wires E. The sealing portion P can be held watertight by rubber plugs 20 mounted on the wires E. However, other possibilities for connection with the wires E, such as insulation displacement or soldering, also can be used.

A flange 13 is formed on an outer circumferential surface 18 of the socket main body D. The flange 13 defines a jaw that substantially covers the contact surface 16*b* and the sealing surface 16*a* of the edge 16 from behind the bulb casing C when the bulb socket S is mounted in the bulb casing C. Thus, the flange 13 projects radially by a radial distance greater than that of the contact surface 16*b* and/or the sealing surface 16*a*.

As O-ring 14 is mounted on the outer circumferential surface 18 of the main body D near and before the flange 13. Thus, the flange 13 prevents the O-ring 14 from moving loosely moving backward. A ring-shaped restricting projection 15 is formed substantially continuously around the outer circumferential surface 18 of the main body D at a location before the O-ring 14. The restricting projection 15 has an outside diameter larger than the diameter of the mount hole 11 and prevents the O-ring 14 from moving loosely forward in the inserting direction ID. Therefore, the O-ring 14 is trapped between the flange 13 and the restricting projection 15. The restricting projection 15 has a slanted rear surface 15*a* that is spaced slightly from the front surface of the O-ring 14 when the rear surface of the O-ring contacts the front surface of the flange 13. The restricting projection 15 also has a push-restricting front surface 15*b* that is substantially normal to the outer circumferential surface of the main body D. As noted above, there is only a small clearance between the inner circumferential surface of the mount hole 11 and the outer circumferential surface of the main body D. Thus, the push-restricting surface 15*b* can be brought substantially into contact with the contact surface 16*b* from behind during the insertion of the bulb socket S, and this contact can prevent the bulb socket S from being pushed in the inserting direction ID into the mount hole 11 deeper than necessary or more than a specified amount.

Two diametrically opposite locking claws 12 project from the main body D at locations spaced forward from the push-restricting surface 15*b* of the restricting projection 15 by a distance slightly longer than the thickness of the annular projection 10. The locking claws 12 are dimensioned and disposed to be introduced through the escaping portions 10*a* of the annular projection 10 during the insertion of the bulb socket S into the mount hole 11 of the bulb casing C. The rear ends of the locking claws 12 are substantially normal to the outer circumferential surface of the main body D and can be brought into contact with the locking surface 16*c* of the edge 16 from inside for locking.

The bulb socket S with the O-ring 14 mounted thereon can be inserted in the inserting direction ID into the mount hole 11 of the bulb casing C with the bulb B faced forward. The locking claws 12 are aligned with and introduced through the escaping portions 10*a* during this insertion, and the O-ring 14 contacts the sealing surface 16*a* of the edge 16. The bulb socket S can be pushed further from this position so that the O-ring 14 is squeezed and deformed resiliently between the sealing surface 16*a*, the front surface of the flange 13, the outer circumferential surface 18 of the main body D and the slanted surface 15*a* of the restricting projection 15. The sealing surface 16*a* is held in pressing contact with the O-ring 14 and pushes the O-ring 14 in an oblique radially inward direction to the back from a radially outward position. On the other hand, the slanted surface 15*a* of the restricting projection 15 pushes the O-ring 14 in an oblique outward direction to the back from a radially inward position. Further, the front surface of the flange 13 pushes the O-ring 14 forward in the inserting direction ID, and the outer circumferential surface 18 of the main body D pushes the ring 14 in a radially outward direction substantially normal to the inserting direction ID of the bulb socket S. With the O-ring 14 pushed by the respective surfaces, the bulb socket S is turned circumferentially to a position where the locking claws 12 are not aligned with the escaping portions 10*a*. Thus, the rear ends of the locking claws 12 face the locking surface 16*c* of the edge 16 to achieve a bayonet coupling. The bulb socket S then is pushed back in a direction opposed to the inserting direction ID with respect to the bulb casing C by the resiliency of the squeezed O-ring 14, and the locking claws 12 engage the locking surface 16*c* of the edge 16 to hold the bulb socket S so as not to come out.

An attempt could be made to push the bulb socket S into the mount hole 11 deeper than necessary during the mounting into the bulb casing C. However, the push-restricting surface 15*b* of the restricting projection 15 contacts the contact surface 16*b* of the edge 16 to limit insertion the bulb socket S in the inserting direction ID and to prevent the O-ring 14 from being squeezed excessively. Thus, sliding resistance between the rear surface of the O-ring 14 and the front surface of the flange 13 and sliding resistance between the front-surface of the bring 14 and the sealing surface 16*a* will not be sufficiently high to exert a shear force on the O-ring 14. As a result, the O-ring 14 will be mounted properly and good sealing is assured.

The bulb socket S can be detached from the bulb casing C by turning the bulb socket S to align the locking claws 12 with the escaping portions 10*a* and then pulling the bulb socket S opposite to the inserting direction ID. Even if the front surface of the O-ring 14 is held in pressing contact with the sealing surface 16*a* of the edge 16 during the detachment, the slanted surface 15*a* of the restricting projection 15 contacts the O-ring 14 from the front as the bulb socket S is detached to separate the O-ring 14 from the sealing surface 16*a*. Thus, the O-ring 14 moves back together with the main body D and remains mounted on the bulb socket S when the bulb socket S is detached.

As described above, the O-ring 14 is prevented from excessive squeezing during the mounting of the bulb socket S and securely displays its sealing functions. Further, the O-ring 14 can be prevented from coming off the bulb socket S during the detachment of the bulb socket S.

The restricting projection 15 is formed continuously over substantially the entire circumference of the main body D. Thus, strength against a backward-acting pushing force from the contact surface 16*b* of the mount hole 11 when the bulb socket S is pushed into the mount hole 11 is high as compared to a bulb socket with a plurality of circumferentially spaced restricting projections on the main body D. Thus, breakage and bending of the restricting projection 15 can be avoided. Further, the push-restricting surface 15*b* of the restricting projection 15 uniformly contacts the contact surface 16*b* over substantially the entire circumference. Therefore, the oblique mounting of the socket main body D into the mount hole 11 can be avoided.

When sealing is provided between the mount hole 11 and the main body D, the O-ring 14 is held in pressing contact with the front surface of the flange 13, the sealing surface 16*a* of the edge 16, the outer circumferential surface 18 of the main body D, and the slanted surface 15*a* of the restricting projection 15. Thus, a sealing area is high and provides secure sealing.

Even if the O-ring 14 is pushed by the restricting projection 15, there is no possibility of locally recessing the O-ring 14 since the contact portion of the restricting projection 15 with the O-ring 14 is the slanted surface 15*a* extending along the outer surface of the O-ring.

Figure 4:
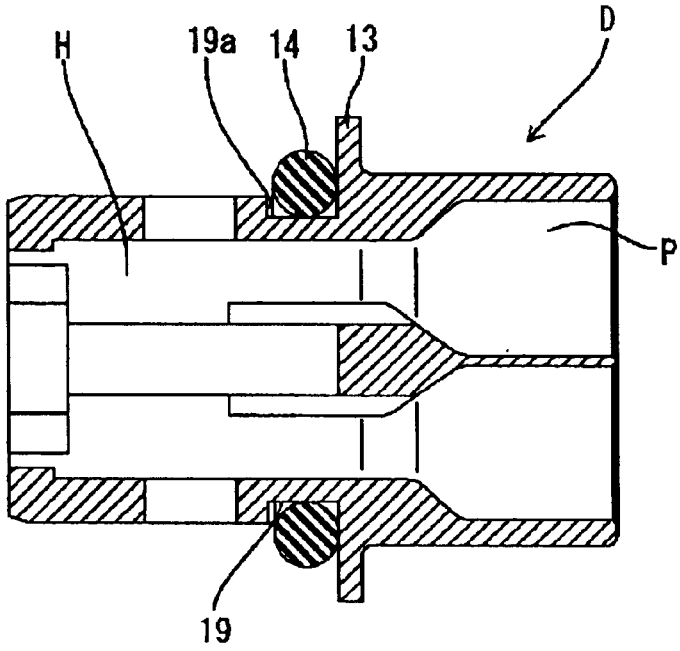
FIG. 4 is a section showing a modification of the socket main body.
Figure 5:
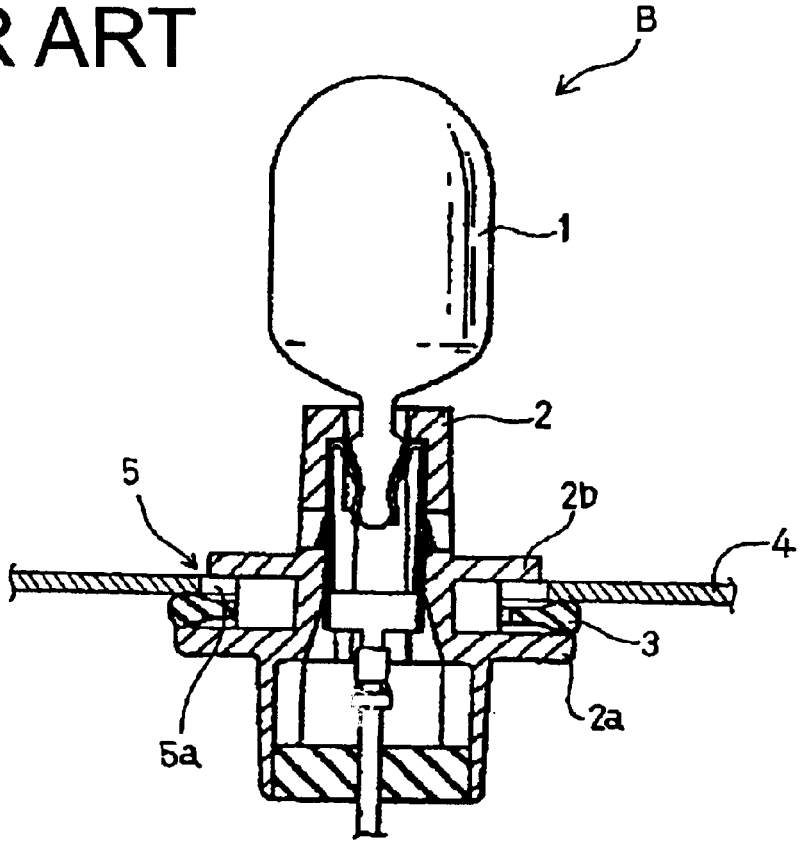
FIG. 5 PRIOR ART
FIG. 5 is a section of a prior art bulb socket.

FIG. 4 shows a modification of the means for preventing the O-ring 14 from coming off. This modification includes a groove 19 formed over the entire circumference of the main body D for receiving the O-ring 14. The O-ring 14 has an inner diameter smaller than the outer diameter of the main body D. Thus, even if the O-ring 14 is held in pressing contact with the sealing surface 16*a* of the edge 16 during the detachment of the bulb socket S, a front surface 19*a* of the groove 19 contacts the O-ring 14 to separate it from the sealing surface 16*a* of the edge 16, thereby displaying the same effect as in the first embodiment.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The slanted surface 15*a* of the restricting projection 15 may be an arcuate surface extending along the outer surface of the O-ring 14.

Although the sealing surface 16*a* of the edge 16 of the mount hole 11 is slanted in the foregoing embodiment, it may extend normal to the mounting and detaching directions of the bulb socket S into and from the mount hole 11.

When sealing is provided between the mount hole 11 and the bulb socket D, the O-ring 14 may not be in contact with the slanted surface 15*a* of the restricting projection 15.

A plurality of restricting projections may be spaced apart in the circumferential direction of the socket main body D.

Even though the bulb socket S has been described to be locked into the socket main body D by inserting the locks 12 into the escaping portion 10*a* and circumferentially turning the bulb socket S and main body D with respect to each other (bayonet coupling), other ways of locking are possible, such as resiliently deflectable locks that engage corresponding mating locks.

What is claimed is:

1. A bulb socket for mounting in a mount hole of a bulb casing the bulb casing having an outside edge surrounding the mount hole and a sealing surface surrounding the outside edge, comprising:

a main body having an outer circumferential surface dimensioned for mounting in the mount hole, said main body being configured to receive a portion of a bulb, a flange being formed on the outer circumferential surface of the main body;

a seal fittable on the outer circumferential surface of the main body adjacent the flange;

at least one lock formed on the outer circumferential surface of the main body and configured for locking the main body to the bulb casing; and a restricting projection extending continuously around the outer circumferential surface of the main body at a position before the seal with respect to an inserting direction of the main body into the mount hole for contacting the inside edge of the mount hole, the restricting projection having a contact surface held in pressing contact with the seal when the seal is squeezed resiliently between the flange on the outer circumferential surface of the main body and the sealing surface surrounding the outside edge of the mount hole, such that the seal provides sealing between the mount hole and the main body.

2. The bulb socket of claim 1, wherein the main body is circumferentially rotatable in the mount hole for engaging the lock with an inside edge of the mount hole.

3. The bulb socket of claim 1, wherein a groove is formed around the outer circumferential surface of the main body for at least partly accommodating the seal therein.

4. A bulb socket for mounting in a mount hole of a bulb casing, comprising:

a main body having an outer circumferential surface dimensioned for mounting in the mount hole, said main body being configured to receive a portion of a bulb;

a seal fittable on the outer circumferential surface of the main body;

a flange on the outer circumferential surface of the main body for contacting the seal and restricting a backward loose movement of the seal, at least one lock formed on the outer circumferential surface of the main body and configured for locking the main body to the bulb casing;

a restricting protection formed on the outer circumferential surface of the main body at a position before the seal with respect to an inserting direction of the main body into the mount hole for contacting an outside edge of the mount hole, such that the seal provides sealing between the mount hole and the main body; and wherein the sealing is provided between the mount hole and the main body by squeezing the seal between the flange and a sealing surface of the edge of the mount hole to resiliently deform the seal in a mounted state of the bulb socket.

5. The bulb socket of claim 4, wherein the restricting projection extends continuously and circumferentially around the main body.

6. The bulb socket of claim 5, wherein the restricting projection has a contact surface held in pressing contact with the seal preferably when the seal is squeezed resiliently between the flange on the outer circumferential surface of the main body and the sealing surface surrounding the outside edge of the mount hole to provide sealing.

7. The bulb socket of claim 6, wherein the restricting projection has a slanted surface extending along the outer circumferential surface of the seal.

8. A bulb socket for mounting in a substantially tubular bulb casing, the bulb casing having an outwardly slanted rear end and an annular wall adjacent and forward of the outwardly slanted rear end, the annular wall having opposite front and rear surfaces and a mount hole extending between the front and rear surfaces, the bulb socket comprising:

a tubular main body having opposite front and rear ends and an outer circumferential surface extending between the ends, the outer circumferential surface being cross-sectionally dimensioned for insertion into the mount hole along an inserting direction;

at least one lock formed on the main body and configured for engaging the bulb casing;

a restricting projection formed on the outer circumferential surface of the main body and being dimensioned for engaging the rear surface of the annular wall when the main body is inserted into the mount hole;

a flange projecting out from the outer circumferential surface of the main body at a location rearward of the restricting projection; and an O-ring trapped between the flange and the restricting projection and dimensioned for sealing engagement with the slanted rear end of the bulb casing when the restricting projection engages the rear surface of the annular wall.

9. The bulb socket of claim 8, wherein the restricting projection extends continuously around the outer circumferential surface of the main body.

10. The bulb socket of claim 9, wherein the restricting projection has a front surface aligned substantially normal to the outer circumferential surface of the main body.

11. The bulb socket of claim 10, wherein the restricting projection has a rear surface aligned at an obtuse angle to the outer circumferential surface of the main body.

12. The bulb socket of claim 11, wherein the outer circumferential surface of the main body has a groove between the flange and the restricting projection, the O-ring being at least partly engaged in the groove.

13. A bulb socket assembly comprising:

a substantially tubular bulb casing, the bulb casing having an outwardly slanted rear end and an annular wall adjacent and forward of the outwardly slanted rear end, the annular wall having opposite front and rear surfaces and a mount hole extending between the front and rear surfaces;

a tubular main body having opposite front and rear ends and an outer circumferential surface extending between the ends, the outer circumferential surface being cross-sectionally dimensioned for insertion into the mount hole along an inserting direction, at least one lock formed on the main body and configured for engaging the bulb casing, a restricting projection formed on the outer circumferential surface of the main body and being dimensioned for engaging the rear surface of the annular wall when the main body is inserted into the mount hole, and a flange projecting out from the outer circumferential surface of the main body at a location rearward of the restricting projection; and an O-ring trapped between the flange and the restricting projection and dimensioned for sealing engagement with the slanted rear end of the bulb casing when the restricting projection engages the rear surface of the annular wall.

14. The assembly of claim 13, wherein the restricting projection extends continuously around the outer circumferential surface of the main body.

15. The assembly of claim 14, wherein the restricting projection has a front surface aligned substantially normal to the outer circumferential surface of the main body.

16. The assembly of claim 15, wherein the restricting projection has a rear surface aligned at an obtuse angle to the outer circumferential surface of the main body.

17. The assembly of claim 16, wherein the outer circumferential surface of the main body has a groove between the flange and the restricting projection, the O-ring being at least partly engaged in the groove.

18. A method for mounting a bulb socket, comprising:

providing a socket main body in which a bulb can be mounted, a flange projecting out on an outer circumferential surface of the socket main body, and a restricting projection projecting out on the outer circumferential surface of the main body at a location spaced axially from the flange;

fitting a seal on the outer circumferential surface of the main body at a location between the flange and the restricting protection;

inserting the main body in a mount hole of a bulb casing such that the restricting projection on the outer circumferential surface of the main body contacts an edge of the mount hole from outside and such that the seal seals the main body to the mount hole by squeezing the seal between the flange and a sealing surface around the edge of the mount hole to resiliently deform the seal in a mounted state of the bulb socket.

19. The method of claim 18, wherein the main body is locked to the bulb casing by circumferentially turning the main body to engage a lock of the main body with an edge of the mount hole from inside.

* * * * *